US009956669B2

(12) United States Patent
Doi et al.

(10) Patent No.: US 9,956,669 B2
(45) Date of Patent: May 1, 2018

(54) POLISHING PAD AND POLISHING METHOD

(71) Applicants: Kyushu University, National University Corporation, Fukuoka-shi, Fukuoka (JP); Fujibo Holdings, Inc., Chuo-ku, Tokyo (JP)

(72) Inventors: Toshiro Doi, Fukuoka (JP); Kiyoshi Seshimo, Fukuoka (JP); Masataka Takagi, Saijo (JP); Hiroshi Kashiwada, Saijo (JP)

(73) Assignees: KYUSHU UNIVERSITY, NATIONAL UNIVERSITY CORPORATION, Fukuoka-shi, Fukuoka (JP); FUJIBO HOLDINGS, INC., Chuo-ku, Tokyo (JP)

( * ) Notice: Subject to any disclaimer, the term of this patent is extended or adjusted under 35 U.S.C. 154(b) by 285 days.

(21) Appl. No.: 14/774,681

(22) PCT Filed: Feb. 27, 2014

(86) PCT No.: PCT/JP2014/054851
§ 371 (c)(1),
(2) Date: Sep. 10, 2015

(87) PCT Pub. No.: WO2014/141889
PCT Pub. Date: Sep. 18, 2014

(65) Prior Publication Data

US 2016/0016292 A1 Jan. 21, 2016

(30) Foreign Application Priority Data

Mar. 12, 2013 (JP) ..... 2013-049471

(51) Int. Cl.
*B24D 13/00* (2006.01)
*B24B 37/24* (2012.01)
*B24B 37/22* (2012.01)
*B24D 11/00* (2006.01)

(52) U.S. Cl.
CPC ..... *B24D 13/00* (2013.01); *B24B 37/22* (2013.01); *B24B 37/24* (2013.01); *B24D 11/00* (2013.01)

(58) Field of Classification Search
CPC ..... B24B 37/22; B24B 37/24; B24D 13/00; B24D 11/00
See application file for complete search history.

(56) References Cited

U.S. PATENT DOCUMENTS 5,014,468 A * 5/1991 Ravipati ..... B24D 3/28 51/293
5,489,233 A * 2/1996 Cook ..... A47L 13/28 451/41
5,876,266 A 3/1999 Miller et al.
(Continued)

FOREIGN PATENT DOCUMENTS

CN 101316683 A 12/2008
EP 0396150 A2 11/1990
(Continued)

*Primary Examiner* — Marc Carlson
(74) *Attorney, Agent, or Firm* — Squire Patton Boggs (US) LLP

(57) ABSTRACT

The present invention provides a polishing pad including a polishing member having a polishing surface, wherein the polishing member contains a material having dilatancy characteristics.

20 Claims, 3 Drawing Sheets

(56) References Cited

U.S. PATENT DOCUMENTS

| | | | | |
|---|---|---|---|---|
| 7,211,121 | B2 * | 5/2007 | Mutoh | C09G 1/02 106/3 |
| 2003/0068960 | A1 * | 4/2003 | Reinhardt | B24B 37/26 451/41 |
| 2003/0139127 | A1 * | 7/2003 | Choi | B24B 37/24 451/526 |
| 2006/0052040 | A1 * | 3/2006 | Prasad | B24B 37/24 451/41 |
| 2006/0213126 | A1 * | 9/2006 | Cho | C09G 1/02 51/298 |
| 2008/0057845 | A1 * | 3/2008 | Prasad | B24B 37/24 451/530 |
| 2009/0305589 | A1 * | 12/2009 | Budden | C08G 77/398 442/59 |
| 2012/0040590 | A1 * | 2/2012 | Burge | B24B 37/24 451/28 |
| 2013/0331014 | A1 * | 12/2013 | Shiro | B24B 37/24 451/532 |
| 2016/0101500 | A1 * | 4/2016 | Fung | B24B 37/015 156/345.12 |

FOREIGN PATENT DOCUMENTS

| | | | | | |
|---|---|---|---|---|---|
| JP | 2002-093757 | A | | 3/2002 | |
| JP | 2003347246 | A | * | 12/2003 | |
| JP | 2006-279050 | A | | 10/2006 | |
| JP | 2009-514690 | A | | 4/2009 | |
| JP | 2003-347246 | | | 12/2013 | |
| TW | 264493 | B | | 12/1995 | |
| TW | 434101 | | | 5/2001 | |
| TW | 200411035 | | | 7/2004 | |
| TW | 201244876 | | | 11/2012 | |
| WO | WO 2007/102020 | | | 9/2007 | |
| WO | WO 2013016779 | A1 | * | 2/2013 | B24B 37/044 |

* cited by examiner

POLISHING PAD AND POLISHING METHOD

TECHNICAL FIELD

The present invention relates to a polishing pad and a polishing method.

BACKGROUND ART

Conventionally, a surface (processing surface) of a thin substrate (object to be polished) such as materials for semiconductor devices, electronic components and the like, in particular, a Si substrate (silicon wafer), a GaAs (gallium arsenide) substrate, glass, and substrates for a hard disk drive and an LCD (liquid crystal display) is required to be flat. Accordingly, chemical mechanical polishing is performed thereon using a polishing pad along with polishing slurry. Meanwhile, some materials which can be applied to forthcoming power devices and the like, such as sapphire, SiC, GaN and diamond, are known as hard-to-process materials, which are difficult to polish.

To date, in an effort to develop a novel polishing technique, materials, structures and polishing conditions for the polishing pad and the polishing slurry have been studied with reference to so-called Prestonian's empirical rule. Simply to say, Prestonian's empirical rule is a rule empirically indicating that the removal rate (polishing rate) of the object to be polished is proportional to a relative speed between the polishing pad and the object to be polished (hereinafter referred to simply as "relative speed"), a pressing force between these (hereinafter referred to simply as "polishing pressure"), and a polishing time. It is known, however, that even an increase in the relative speed and the polishing pressure based on Prestonian's empirical rule is not sufficient for efficiently polishing the object to be polished (hereinafter also referred to as "workpiece"), in particular, the hard-to-process material in a short time because of factors such as limitation in capability of the polishing apparatus.

Therefore, slurry which exhibits non-Prestonian behavior has been studied as the polishing slurry. For example, Patent Document 1, which is intended to provide a method for manufacturing polishing slurry in which dispersion stability is improved and which exhibits non-Prestonian polishing characteristics, proposes a method for manufacturing polishing slurry, the method including: (a) a step of dispersing abrasive particles and a dispersing agent of anionic polymer acid in water; and (b) a step of adding, to the generated dispersion, an alkaline substance of an amount of 0.1 to 8 parts by weight on the basis of 100 parts by weight of abrasive particles as a reference.

CITATION LIST

Patent Document

Patent Document 1: Japanese Patent Application Laid-Open No. 2006-279050

SUMMARY OF INVENTION

Technical Problem

After studied conventional techniques such as one disclosed in Patent Document 1 above, however, the inventors found that the conventional techniques are not sufficient yet to efficiently polish the object to be polished in a short time.

Specifically, according to Patent Document 1 (in particular, paragraph [0043] and FIG. 3), it is described that the non-Prestonian behavior is observed in which the polishing rate does not linearly increase proportional to the polishing pressure but steeply increase at pressures not less than the critical point. Nevertheless, as apparent from FIG. 3, in the case of using the polishing slurry according to Patent Document 1, the polishing rate at low polishing pressure is smaller than that in the case of ordinary polishing slurry. Hence, even if the polishing rate steeply increases at pressures not less than the critical point, efficient polishing cannot be performed in a shorter time than in the case of the ordinary polishing slurry.

The present invention has been made in view of the above-mentioned circumstances, and an object thereof is to provide a polishing pad capable of efficiently polishing an object to be polished in a short time, and a polishing method using the polishing pad.

Solution to Problem

The inventors have pursued intensive studies to achieve the above-mentioned object, and as a result, have found that an object to be polished can be efficiently polished in a short time by adopting a material which exhibits specific behavior as a material constituting a polishing surface in a polishing pad, having completed the present invention.

Specifically, the present invention is as follows.

[1] A polishing pad comprising a polishing member having a polishing surface, wherein the polishing member contains a material having dilatancy characteristics.

[2] The polishing pad according to [1], wherein the material having the dilatancy characteristics contains a resin having dilatancy characteristics, or an inorganic particle composition having dilatancy characteristics which contains inorganic particles and medium liquid.

[3] The polishing pad according to [2], wherein the material having the dilatancy characteristics which contains the resin having the dilatancy characteristics further contains inorganic particles.

[4] The polishing pad according to [2] or [3], wherein the resin having the dilatancy characteristics contains a silicone resin having dilatancy characteristics.

[5] The polishing pad according to any one of [1] to [4], wherein the polishing member contains a sheet-like fiber base material, and the material having the dilatancy characteristics with which the fiber base material is impregnated.

[6] The polishing pad according to any one of [1] to [5], wherein the polishing member contains a base material having a recess part, and the material having the dilatancy characteristics with which an interior of the recess part is filled.

[7] A polishing method comprising a step of polishing an object to be polished using the polishing pad according to any one of [1] to [6].

Advantageous Effects of Invention

According to the present invention, there can be provided a polishing pad capable of efficiently polishing an object to be polished in a short time, and a polishing method using the polishing pad.

DESCRIPTION OF EMBODIMENTS

Figure 1:
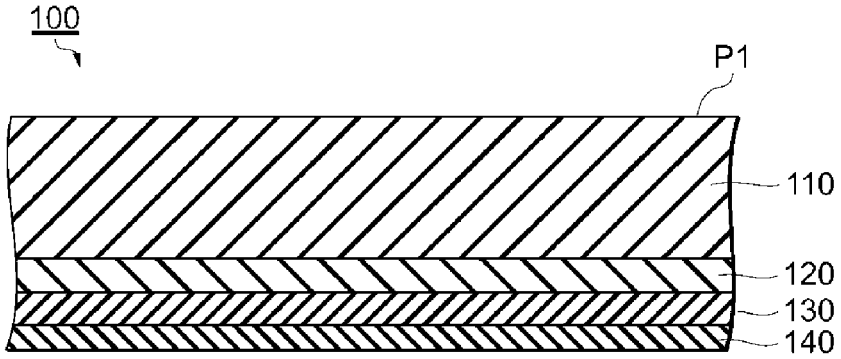
FIG. 1 is a schematic cross-sectional view showing an example of a polishing pad of the present invention.

Hereafter, a mode for carrying out the present invention (hereinafter referred to simply as the "present embodiment") is described in detail, referring to the drawings as needed. The same elements in the drawings are given the same signs, and the duplicated description is omitted. Moreover, positional relations such as being at the top, the bottom, the left and the right are supposed to be based on the positional relations shown in the drawings unless otherwise noted. Furthermore, ratios between the dimensions in the drawings are not limited to the ratios shown in the drawings.

A polishing pad of the present embodiment is a polishing pad including a polishing member having a polishing surface, wherein the polishing member contains a material having dilatancy characteristics. Herein, the "material having dilatancy characteristics" means a material that has higher viscosity at the time when shearing strain is given as compared with the case where the shearing strain is not given. In the present embodiment, even a material that has higher viscosity at the time when shearing strain is given at a frequency of a certain degree (in other words, at a shearing speed of a certain degree) as compared with the case where the shearing strain is given at a frequency lower than that (in other words, at a shearing speed lower than that) corresponds to the material having dilatancy characteristics.

Whether or not a material is the material having dilatancy characteristics (hereinafter referred to simply as "dilatant material") can be determined as follows. First, two samples are prepared, where one obtained by molding a material as the measurement target into a rectangular solid with 2 mm of thickness, 5 mm of width and 10 mm of length is set to be each of the samples. Next, a jig for solid shearing measurement (fixed jig) is interposed between the two samples in the thickness direction of the samples, and furthermore, these are interposed between two jigs for solid shearing measurement (jigs for giving vibration) other than the above in the thickness direction (stacking direction) of the samples. Then, the jigs for giving vibration are vibrated in the shearing direction of the samples (direction perpendicular to the thickness direction) under the conditions of the operating temperature of the polishing pad, two or more kinds of predetermined frequencies, and 0.1% of shearing strain amount, and thereby, complex moduluses of elasticity at the respective frequencies are measured. Examples of an apparatus which can measure the complex moduluses of elasticity in this way can include, for example, a dynamic viscoelasticity measurement apparatus (Model: DVA-200/L2) made by IT Keisoku Seigyo K.K. As a result, when a ratio of the complex modulus of elasticity at the time when the higher frequency is given relative to the complex modulus of elasticity at the time when the lower frequency is given (dilatant coefficient, which is hereinafter expressed as "D coefficient") exceeds 1.0, it is decided that the material is a dilatant material. In view of more effectively and securely achieving the object of the present invention, the dilatant material preferably has a D coefficient exceeding 3.0 which is the ratio of the complex modulus of elasticity ($G^*_{100\ Hz}$) at the time when 100 Hz of frequency is given relative to the complex modulus of elasticity ($G^*_{1\ Hz}$) at the time when 1 Hz of frequency is given ($G^*_{100\ Hz}/G^*_{1\ Hz}$) at 30° C. which is a temperature close to the actual polishing temperature. The D coefficient of the dilatant material can be controlled by properly adjusting kinds of materials contained in the dilatant material and the compounding ratios between these. Notably, the complex modulus of elasticity is measured in the temperature profile in which the temperature is elevated from −20° C. at 10° C./min, and the temperature is held for two minutes and the elevation is resumed for every 10° C.-elevation with the samples being vibrated at the predetermined frequency, in the temperature range up to 80° C., and as mentioned above, the D coefficient is calculated based on the results of the complex moduluses of elasticity at the temperature of 30° C. The upper limit of the D coefficient is not specially limited, but, for example, the D coefficient may be 10.0 or less, may be 8.0 or less, or may be 6.0 or less.

The dilatant material preferably has a complex modulus of elasticity at the time when 50 Hz of frequency is given at 30° C. being from $2.0\times10^5$ Pa or more to $6.0\times10^7$ Pa or less, still preferably being from $1.0\times10^6$ Pa or more to $4.0\times10^7$ Pa or less. By the complex modulus of elasticity at 50 Hz being $2.0\times10^5$ Pa or more, an effect can be obtained by which a dynamic material value of the material (hardness of the material) in consideration of energy lost as heat in deformation is further enhanced and polishing efficiency is further improved. Moreover, by the complex modulus of elasticity at 50 Hz being $6.0\times10^7$ Pa or less, an effect can be obtained by which polishing quality is made further favorable. The complex modulus of elasticity at 50 Hz can be measured by the similar method to the above for measuring the complex modulus of elasticity at the time when the D coefficient is calculated except for changing the frequency from 1 Hz and 100 Hz to 50 Hz.

Examples of the dilatant material can include, for example, a resin having dilatancy characteristics (hereinafter referred to as "dilatant resin"), a starch composition having dilatancy characteristics (hereinafter referred to as "dilatant starch composition"), and an inorganic particle composition having dilatancy characteristics (hereinafter referred to as "dilatant inorganic particle composition"). Moreover, materials known as the material having dilatancy characteristics can also be used as the dilatant material according to the present embodiment. One kind of these is solely used or two or more kinds of these are combined and used.

Examples of the dilatant resin can include, for example, a silicone resin having dilatancy characteristics and polyurethane having dilatancy characteristics. Examples of the silicone resin having dilatancy characteristics can include, for example, a dimethylpolysiloxane resin whose terminal may have a substituent, and a dimethylpolysiloxane resin which is crosslinked with boron. Examples of the dimethylpolysiloxane resin which is crosslinked with boron can include, for example, polyborodimethylsiloxane disclosed in National Publication of International Patent Application No. 2007-516303. Moreover, as commercially available ones, examples of the above-mentioned dimethylpolysiloxane resin whose terminal and side chain may have substituents can include, for example, a hydroxy-terminated dimethylpolysiloxane resin contained in "DOW CORNING (registered trademark) 3179 DILATANT COMPOUND" (product name) made by Dow Corning Corporation, one made by Shin-Etsu Chemical Co. Ltd., and moreover, one contained in Snatch Clay (product name) series (for example, product numbers: BX-050C, BX-100C, BX-050T and BX-100T) made by Bouncy. Examples of the polyurethane having dilatancy characteristics can include, for example, one disclosed in Japanese Patent Laid-Open No. 5-320305.

In the case of using the dilatant resin, the dilatant material may be a resin composition having dilatancy characteristics (hereafter referred to as "dilatant resin composition") which contains other components in addition to the resin. Examples of the components other than the dilatant resin contained in the dilatant resin composition can include, for example: a modifying agent which gives the dilatant material hydrophilicity, such as a hydroxyl group-containing silicone resin; a solvent and a dispersion medium such as silicone oil (hereinafter, the solvent and the dispersion medium are collectively referred to as "medium liquid"); inorganic particles such as inorganic oxide particles (for example, particles of ceria ($CeO_2$), silica ($SiO_2$), alumina ($Al_2O_3$), zirconia ($ZrO_2$), manganese oxide ($MnO_2$, $Mn_2O_3$, $Mn_3O_4$ and the like) and titania ($TiO_2$)), clay mineral particles (for example, particles of kaolinite, antigorite, pyrophyllite, illite, montmorillonite and vermiculite), diamond particles, SiC particles, and $B_4C$ particles; and a thickening agent such as methylcellulose and hydroxymethylene cellulose. One kind of these is solely used or two or more kind of these are combined and used. The dilatant resin composition, containing the inorganic particles, is preferable in view of the dilatant resin composition being further liable to be held in the polishing pad, and in view of polishing slurry being liable to fit water contained in the polishing slurry which is enhanced in hydrophilicity. Thereby, as a result, polishing characteristics of the polishing pad are further improved. Examples of the dilatant resin composition can include, for example, "DOW CORNING (registered trademark) 3179 DILATANT COMPOUND" (product name) and Snatch Clay (product name) series (for example, product numbers: BX-050C, BX-100C, BX-050T and BX-100T) mentioned above.

The content ratio of each component contained in the dilatant resin composition is not specially limited as long as it is in a range where the dilatant resin composition has the dilatancy characteristics. For example, the content ratio of the dilatant resin based on the total amount of the dilatant resin composition is preferably from 50 mass % or more to less than 100 mass %, still preferably from 70 mass % or more to less than 100 mass %, in view of holding more favorable dilatant characteristics. Moreover, in the case where the dilatant resin composition contains the inorganic particles along with the dilatant resin, in addition to the above-mentioned preferable content ratio of the dilatant resin, the content ratio of the inorganic particles is preferably from 20 mass % or more to 30 mass % or less in view of holding the above-mentioned effects achieved by containing the inorganic particles while holding more favorable dilatant characteristics. Moreover, the average particle diameter of the inorganic particles is preferably from 100 nm or longer to 5.0 μm or shorter, still preferably from 200 nm or longer to 1.5 μm or shorter, further preferably from 250 nm or longer to 1.0 μm or shorter, in view of more effectively and securely achieving the effects of the present invention due to the dilatant material.

The dilatant inorganic particle composition contains inorganic particles and medium liquid and has dilatancy characteristics. Examples of the material constituting the inorganic particles can include, for example, inorganic oxide such as ceria, silica (for example, nanosilica) and titania ($TiO_2$), and clay mineral such as kaolinite, antigorite, pyrophyllite, illite, montmorillonite and vermiculite, and the like. Above all, the inorganic oxide is preferable and ceria is still preferable in view of more effectively and securely holding the dilatant characteristics. Examples of the medium liquid can include, for example, water, lower alcohol such as ethanol and propanol, lower glycol such as ethylene glycol and propylene glycol, glycol ethers, and aqueous solutions of these, and above all, water is preferable. One kind of these is solely used and two or more kinds of these are combined and used. It should be noted that there is sometimes a case in which in the case of using polishing slurry containing water, the dilatant inorganic particle composition results in dispersion of the inorganic particles in the water, and thus, deterioration of polishing efficiency. In such a case, for example, addition of a small amount of the above-mentioned dilatant resin composition can improve the situation.

The content ratio of each component contained in the dilatant inorganic particle composition is not specially limited as long as it is in a range where the dilatant inorganic particle composition has the dilatancy characteristics. For example, the content ratio of the inorganic particles based on the total amount of the dilatant inorganic particle composition is preferably from 70 mass % or more to 95 mass % or less, still preferably from 80 mass % or more to 85 mass % or less, in view of holding more favorable dilatant characteristics. From the similar point of view, the content ratio of the medium liquid is preferably from 5 mass % or more to 30 mass % or less, still preferably 15 mass % or more to 20 mass % or less. In this case, the inorganic particles are preferably inorganic oxide particles and the medium liquid is preferably water since further favorable dilatant characteristics can be held.

The dilatant material of the present embodiment is different from a polishing material (abrasive grains) and polishing slurry which are not held in the polishing pad (that is, move on the polishing pad to be discharged out of the system during polishing) but are newly supplied in the midway of polishing in that it is held in the polishing pad in advance and is not newly supplied in the midway of polishing except for one which is polished due to abrasion and discharged from the system. In other words, in the present embodiment, the dilatant material has characteristics with which it can be held in the polishing pad during storage and use of the polishing pad. Moreover, the dilatant material has a function that the newly supplied polishing slurry (abrasive grains) is allowed to stay on the polishing pad and be liable to be held thereon. Since the dilatant material has exceedingly higher viscosity than the viscosity of the polishing slurry at the operating temperature of the polishing pad, and exceedingly low fluidity, it is extremely hard to be lost from the polishing pad except as polishing sludge.

Next, several aspects are exemplarily presented for the polishing pad of the present embodiment. It should be noted that the polishing pad of the present invention is not limited to those.

In a polishing pad of a first aspect of the present embodiment, a polishing member contains a sheet-like fiber base material and a dilatant material with which the fiber base material is impregnated. FIG. 1 is a schematic cross-sectional view exemplarily showing such a polishing pad. The polishing pad 100 shown in FIG. 1 includes a polishing layer 110 which is the polishing member containing the sheet-like fiber base material and the dilatant material with which the fiber base material is impregnated, a supporting member 120 which supports the polishing layer 110, a double-sided adhesive tape 130, and a release sheet 140, these stacked in this order. The polishing pad 100 causes a polishing surface P1 of the polishing layer 110 to come into contact with an object to be polished and polish it.

The sheet-like fiber base material is not specially limited as long as it can be used as a base material of a polishing cloth, but may be conventionally known. While the sheet-like fiber base material may be non-woven fabrics in which fibers are tangled up, textile fabrics, or knit, it is preferably the non-woven fabrics in view of more effectively and securely achieving the effects of the present invention. A method for tangling up fibers at the time of obtaining the non-woven fabrics is not specially limited, but, for example, it may be a needle punch method, or may be a spunlace, thermal bonding, chemical bonding, stitch bonding, or steam jet method. Moreover, a fiber material of the sheet-like fiber base material may be any of natural fibers and synthetic fibers, and examples thereof can include, for example, natural fibers such as cotton and hemp, and synthetic fibers such as resin fibers such as polyester such as polyethylene telephthalate (PET) and others, polyamide, polyurethane, polypropylene, polyethylene and a (meth)acrylic resin. Above all, a material selected from the group consisting of polyester, polyamide, polypropylene, polyethylene and a (meth)acrylic resin is preferable. As to the fiber materials, one kind of these is solely used or two or more kinds of these are combined and used.

While a preferable range of the fineness of the fibers differs also depending on the kind of the fiber material, it is preferably from 2 d or more to 12 d or less, still preferably from 2 d or more to 6 d or less, in general. By the fineness being not less than the above-mentioned lower limit value, the polishing layer tends to be liable to hold gaps for the impregnation. Moreover, by the fineness being not more than the above-mentioned upper limit value, the polishing layer tends to have more favorable softness and to be liable to have more uniform recoverability.

The density of the fiber base material is preferably from 0.05 g/cm$^3$ or more to 0.30 g/cm$^3$ or less, still preferably from 0.10 g/cm$^3$ or more to 0.20 g/cm$^3$ or less. By the density being not less than the above-mentioned lower limit value, the dilatant material can be further uniformly molded and held. Moreover, by the density being not more than the above-mentioned upper limit value, the impregnation processing of the dilatant material can be made further easy and more dilatant material can be held.

The dilatant material with which the sheet-like fiber base material is impregnated only has to be the above-mentioned dilatant material of the present embodiment, it has been already described and its description is omitted here.

The compounding ratio of the fiber base material and the dilatant material in the polishing layer 110 is not specially limited, but the compounding ratio in which the fiber base material is from 10 parts by mass or more to 40 parts by mass or less based on the total amount of those which is 100 parts by mass is preferable, and the compounding ratio in which it is from 20 parts by mass or more to 30 parts by mass or less is still preferable. By the compounding ratio being not less than the above-mentioned lower limit value, ability of holding the dilatant material by the fiber base material can be made higher. Moreover, by the compounding ratio being not more than the above-mentioned upper limit value, the polishing layer becomes further large in difference between viscosities before and after the shearing strain is given and further favorable to dilatancy characteristics. Notably, in the polishing layer 110, at least the polishing surface P1 that comes into contact with the object to be polished is sufficient to be impregnated with the dilatant material, and the entirety of the polishing layer 110 is not necessarily needed to be impregnated.

The thickness of the polishing layer 110 is preferably from 0.5 mm or more to 10.0 mm or less, still preferably from 1.0 mm or more to 3.0 mm or less. By the thickness being not less than the above-mentioned lower limit value, the polishing layer 110 can have further favorable dilatancy characteristics. Moreover, by the thickness being not more than the above-mentioned upper limit value, edge roll-off of the workpiece by using polishing pad 100 can be made smaller. The thickness is measured based on the Japanese Industrial Standards (JIS K 6505).

The D coefficient of the polishing layer 110 (ratio of the complex modulus of elasticity at the time when 100 Hz of frequency is given relative to the complex modulus of elasticity at the time when 1 Hz of frequency is given at 30° C.) is preferably 1.5 or more, still preferably 2.0 or more, in view of more efficiently and securely achieving the object of the present invention. The D coefficient of the polishing layer 110 can be measured similarly to the D coefficient of the dilatant material. The D coefficient of the polishing layer 110 can be controlled by adjusting the compounding ratio of the dilatant material and the sheet-like fiber base material, and/or by properly adjusting kinds of the materials contained in the dilatant material and the compounding ratios thereof. The upper limit of the D coefficient of the polishing layer 110 is not specially limited, but, for example, the D coefficient may be 8.0 or less, may be 6.0 or less, or may be 4.0 or less.

The density of the polishing layer 110 is preferably from 0.60 g/cm$^3$ or more to 1.0 g/cm$^3$ or less, still preferably from 0.75 g/cm$^3$ or more to 0.95 g/cm$^3$ or less. By the density being 0.60 g/cm$^3$ or more, an effect of suppressing setting (suppressing permanent strain) of the polishing cloth due to polishing pressure can be more effectively obtained. Moreover, by the density being 1.0 g/cm$^3$ or less, an effect that further sufficient polishing pressure can be obtained (a pressure decrease at the point of application caused by an increase in contact area is suppressed) at the contact point with the workpiece can be achieved. As a result of these, the density which falls within the above-mentioned range is liable to afford the polishing cloth which can secure further sufficient flatness of the object to be polished as well as a higher polishing rate and a longer operation time of the polishing cloth. The density is measured based on the Japanese Industrial Standards (JIS K 6505).

The materials and the thicknesses of the supporting member 120, the double-sided adhesive tape 130 and the release sheet 140 included in the polishing pad 100 are not specially limited, but may be the same as those used for a conventional polishing pad. In the polishing pad 100 of the present embodiment, while the supporting member 120 is not essential, examples of the supporting member 120 can include, for example, a PET film, and examples of the double-sided adhesive tape 130 can include, for example, one in which adhesive agent layers such as an acrylic adhesive agent are formed on both surfaces of a flexible base material such as a PET film. Moreover, the supporting member 120 may be joined with the polishing layer 110 using a not-shown adhesive or the like.

A method for manufacturing the polishing pad 100 is not specially limited except for the polishing layer 110 is prepared, for example, as follows, and it may be similar to a conventional one. The polishing layer 110 is obtained by the sheet-like fiber base material impregnated with the dilatant material. In the case where the dilatant material gains fluidity under heating (for example, in the case where it is a thermoplastic resin having dilatant characteristics or a resin composition containing the thermoplastic resin), after the dilatant material is placed on the fiber base material, the entirety of these is contained in a container and heated in a thermostatic oven or the like, and thereby, the placed dilatant material is caused to flow to impregnate the fiber base material therewith. After that, the entirety is cooled, and is cut and molded as needed, thereby affording the polishing layer 110 having the fiber base material impregnated with the dilatant material. Otherwise, in the case where the dilatant material does not gain fluidity even under heating (for example, in the case where it is a thermosetting resin having dilatant characteristics or a resin composition containing the thermosetting resin, or in the case where it is a dilatant starch composition or a dilatant inorganic particle composition), after mixing the thermosetting resin, the starch or the inorganic particles with medium liquid in advance so as to gain fluidity, the fiber base material is immersed in the mixture liquid. Next, these are dried to evaporate and remove the medium liquid so as to gain dilatant characteristics, and thereby, the fiber base material impregnated with the dilatant material is obtained. After that, it is cut and molded as needed, thereby affording the polishing layer 110 having the fiber base material impregnated with the dilatant material.

In the polishing pad 100 of the first aspect, the polishing layer 110 includes the dilatant material which has higher viscosity by giving higher shearing strain as compared with the case of giving lower shearing strain. As a result, the polishing layer 110 has the dilatancy characteristics, hence, the polishing rate of the object to be polished is dramatically enhanced when the relative speed is raised and the polishing pressure is increased in polishing, and thus, the polishing time can be dramatically reduced as compared with a polishing pad including a polishing layer using only a conventional material according to Prestonian's empirical rule. Furthermore, when polishing slurry is used in chemical mechanical polishing or the like, since the abrasive grains in the polishing slurry are embedded and held in the dilatant material, the polishing rate can be more enhanced. Moreover, since the dilatant material contained in the polishing layer 110 changes the viscosity as the relative speed changes, when the abrasive grains are desired to be efficiently embedded in the dilatant material, the relative speed and the polishing pressure only have to be reduced. After that, when the relative speed and the polishing pressure are increased, since the dilatant material has the elevated viscosity and more rigidly holds the abrasive grains embedded therein, the abrasive grains can be effectively used for polishing. Specifically, according to the present aspect, while the polishing is being continued, both to embed and hold the abrasive grains can be more efficiently and securely performed. Moreover, since the polishing layer 110 has the sheet-like fiber base material impregnated with the dilatant material, the polishing surface P1 of the polishing layer 110 has relatively uniform hardness and is relatively flat. Therefore, the object to be polished can be more uniformly polished. Furthermore, since the fiber base material is impregnated with the dilatant material and the dilatant material is uniformly distributed on the entirety of the polishing surface P1, the effects of the dilatant material can be more effectively realized over the entirety of the polishing surface P1. Moreover, for the first aspect, while the sheet-like fiber base material is presented as the base material of the polishing pad 100, a conventional polishing pad formed by a sheet-like fiber base material such as non-woven fabrics impregnated with a resin such as polyurethane can be set to be the base material, forming the polishing pad according to the present embodiment by it further being impregnated with the dilatant material.

Figure 2:
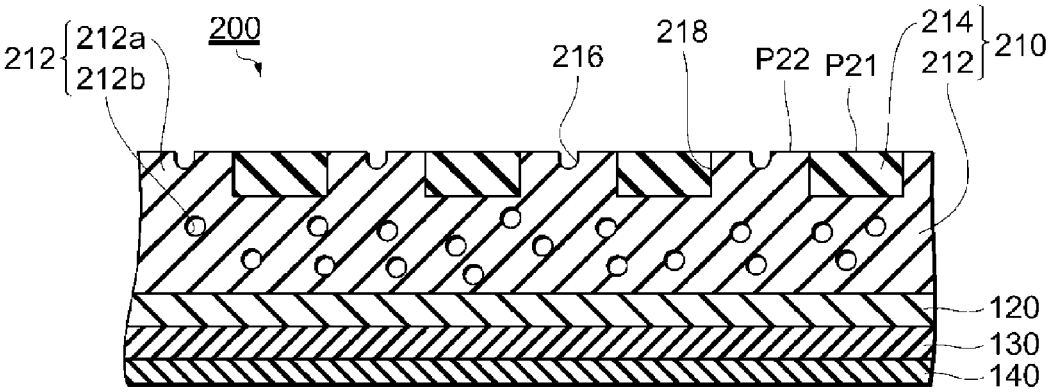
FIG. 2 is a schematic cross-sectional view showing another example of the polishing pad of the present invention.

In a polishing pad of a second aspect of the present embodiment, a polishing member contains, a base material having recess parts and a dilatant material with which the interiors of the recess parts are filled. FIG. 2 is a schematic cross-sectional view exemplarily showing such a polishing pad. A polishing pad 200 shown in FIG. 2 includes a polishing layer 210 which is a polishing member containing a base material 212 having recess parts 218 and a dilatant material 214 with which the interiors of the recess parts 218 are filled, the supporting member 120 supporting the polishing layer 210, the double-sided adhesive tape 130 and the release sheet 140, these stacked in this order. The polishing pad 200 causes a polishing surface P21 based on the dilatant material 214 of the polishing layer 210 and a polishing surface P22 based on the base material 212 thereof to come into contact with the object to be polished and polish it. Moreover, grooves 216 are formed on the polishing surface P22 of the polishing layer 210. The supporting member 120, the double-sided adhesive tape 130 and the release sheet 140 are the same as those included in the above-mentioned polishing pad 100 of the first aspect, and their description is omitted.

The base material 212 shows elasticity and includes a matrix resin 212*a* in which a plurality of pores 212*b* are formed. A method for forming the pores 212*b* is not specially limited, but may be a conventionally known method. For example, the pores 212*b* can be formed by dispersing hollow fine particles in the matrix resin 212*a*, by compounding a chemical foaming agent in the matrix 212*a* for gas evolution foaming, or by kneading and mixing the matrix resin 212*a* and inert gas under pressure for gas evolution foaming under reduced pressure. Notably, as a base material, one similar to the base material 212 except for the absence of the pores 212*b* can be used.

The base material 212 is not specially limited as long as it is used as a polishing layer of a conventional polishing pad, in particular, a hard polishing pad, and, for example, examples of the matrix resin 212*a* can include a polyurethane resin, a polynorbornene resin, a trans-polyisoprene resin, and a styrene-butadiene resin. One kind of these is solely used or two or more kinds of these are combined and used. Above all, the polyurethane resin is preferable, the matrix resin 212*a* preferably contains 50 mass % or more of polyurethane resin, still preferably contains 80 mass % or more thereof, further preferably contains 90 mass % or more thereof, and particularly preferably contains 95 mass % or more thereof in view of availability and workability, and further effectively and securely achieving the object of the present invention.

Examples of the polyurethane resin can include, for example, a polyester-based polyurethane resin, a polyether-based polyurethane resin, and a polycarbonate-based polyurethane resin, and one kind of these is solely used or two or more kinds of these are combined and used. Above all, the polyether-based polyurethane resin is preferable in view of more effectively and securely achieving the object of the present invention.

The polyurethane resin may be synthesized by a conventional method, or may be obtained as a commercial product. Examples of the commercial product can include, for example, SMP (product name of SMP Technologies Inc.), and DiAPLEX (product name of Mitsubishi Heavy Industries, Ltd.).

The polynorbornene resin may be synthesized by a conventional method, or may be obtained as a commercial product. Examples of the commercial product can include, for example, Norsorex (product name of Zeon Corporation). The trans-polyisoprene resin may be synthesized by a conventional method, or may be obtained as a commercial product. Examples of the commercial product can include, for example, Kuraray TPI (product name of Kuraray Co. Ltd.). The styrene-butadiene resin may be synthesized by a conventional method, or may be obtained as a commercial product. Examples of the commercial product can include, for example, Asmer (product name of Asahi Kasei Corporation).

Hereafter, as to the base material 212, the case where the polyurethane resin is adopted as the matrix resin 212*a* is described. The matrix resin 212*a* preferably has an isocyanate group-containing compound as a main component, and the base material 212 has the polishing surface P22 which comes into contact with the polished surface (processing surface) of the object to be polished via the polishing slurry in polishing as needed. The matrix resin 212*a* is formed by performing slicing processing or surface grinding processing such as buffing on a molded body of the polyurethane resin formed from mixture liquid in which the isocyanate group-containing compound and the active hydrogen compound are mixed.

The glass-transition temperature of the matrix resin 212*a* is preferably from 30° C. or more to 90° C. or less, still preferably from 30° C. or more to 75° C. or less, in view of heat resistance and stability in dimensions of the polishing pad. The glass-transition temperature is measured by a dynamic viscoelasticity measurement apparatus.

Moreover, a higher melting point of the matrix resin 212*a* than the glass-transition temperature to some extent can prevent the polishing surface P22 from excessively softening even when the temperature of the polishing surface P22 increases too high in polishing and dressing processing using the polishing pad 200. From such a point of view, the melting point of the matrix resin 212*a* is preferably 150° C. or more, still preferably 160° C. or more. The melting point is measured by a differential scanning calorimetry apparatus.

A volume ratio of the pores 212*b* in the base material 212 is preferably from 10 volume % or more to 60 volume % or less, still preferably 15 volume % or more to 45 volume % or less, based on the entirety of the base material 212. By the volume ratio of the pores 212*b* falling within the above-mentioned range, ability of holding the slurry and maintaining the hardness can be further enhanced.

The base material 212 according to the present embodiment preferably has 80% or more of a closed pore ratio, still preferably 90% or more thereof. Within such a range of the closed pore ratio, the polishing layer 210 hardly holds extra polishing slurry (extra polishing slurry hardly stays on the polishing layer 210), sinking of the polishing layer arising in pressing the object to be polished onto the polishing layer 210 is quickly set free when pressing of the object to be polished is released, and the polishing layer 210 resumes the original shape (hereinafter, such a property is referred to as "recovery characteristics"). Excellent recovery characteristics mean that dishing or erosion hardly arises. Herein, the "closed pore ratio" means a ratio of closed pores that are not joined with other pores out of the pores included in the base material 212, and is synonymous with the "closed-cell ratio". The upper limit of the closed pore ratio is not specially limited. The closed pore ratio is measured based on ASTM D2856 (1998).

The base material 212 according to the present embodiment preferably has from 25° or more to 70° or less of Shore D hardness, still preferably from 30° or more to 60° or less thereof. By the Shore D hardness being not less than the above-mentioned lower limit value, sinking of the base material 212 is suppressed in polishing and the object to be polished can be further highly flattened, and by the same being not more than the above-mentioned upper limit value, scratches on the object to be polished can be further suppressed from arising. The Shore D hardness is measured based on JIS-K-6253 (2012).

The base material 212 according to the present embodiment preferably has from 0.50 g/cm$^3$ or more to 1.00 g/cm$^3$ or less of density (bulk density), still preferably from 0.60 g/cm$^3$ or more to 0.90 g/cm$^3$ or less thereof. By the density being not less than the above-mentioned lower limit value, sinking of the base material 212 is suppressed in polishing and the object to be polished can be further highly flattened, and by the same being not more than the above-mentioned upper limit value, ability of holding the polishing slurry can be enhanced and scratches on the object to be polished can be further suppressed from arising. The density is measured based on JIS-K-7222 (2005).

The thickness of the base material 212 according to the present embodiment is not specially limited, and, for example, may be from 0.5 mm or more to 3.0 mm or less. Moreover, the base material 212 may have not-shown openings on the polishing surface P22.

A method for manufacturing the base material 212 only has to be similar to a method for manufacturing a polishing layer in a conventional hard polishing pad. For example, when the matrix resin 212*a* is a polyurethane resin, the base material 212 can be obtained by so-called dry molding having: a raw material preparing step of preparing an isocyanate group-containing compound, an active hydrogen compound, and as needed, hollow fine particles or the like; a mixing step of preparing mixture liquid obtained by mixing the isocyanate group-containing compound, the active hydrogen compound, and as needed, the hollow fine particles or the like; a mold injection step of injecting the mixture liquid into a mold; a setting and molding step of forming a molded body of polyurethane in the mold; and a base material forming step of performing slicing processing and/or surface grinding processing on the molded body of polyurethane to obtain the base material 212.

The recess parts 218 can be formed on the polishing surface P22 side of the base material 212 obtained as mentioned above using a tool for forming openings such as an endmill or a rooter. Otherwise, the recess parts 218 may be formed by molding with a mold in the mold injection step and the setting and molding step for the base material 212. The depth of the above-mentioned recess parts 218 is preferably 0.5 mm or more, still preferably 0.8 mm or more, in view of more effectively and securely achieving the effects of the present invention due to the dilatant material 214 with which they are filled. The upper limit of the depth of the recess parts 218 is not specially limited, and in place of the recess parts 218, through holes (not shown) which penetrate the base material 212 in its thickness direction may be formed.

The size of the openings of the recess parts 218 is not specially limited, but the longest distance (diameter in the case where the opening shape is circular; diagonal distance in the case where the opening shape is rectangular) may be from 5 mm or more to 50 mm or less. Moreover, the distance (pitch) between adjacent opening ends of the recess parts 218 is not specially limited, but the shortest portion may be from 1 mm or more to 10 mm or less and the longest portion may be from 1 mm or more to 25 mm or less.

The opening shape and the cross-sectional shape of the recess parts 218 are not specially limited, the opening shape may be circular, rectangular or indefinite, and while the cross-sectional shape may be rectangular as shown in the figure, instead, it may be so-called V-shaped, so-called U-shaped, or semi-circular. The cross-sectional shape is preferably rectangular as shown in the figure in view of making the thickness of the dilatant material 214 with which the recess parts 218 are filled more uniform and making the polishing effect due to the dilatant material 214 more uniform.

The grooves 216 are preferably provided in view of supplying the polishing slurry and discharging the polishing sludge in polishing, and are formed by performing groove processing or emboss processing on the polishing surface P22 of the base material 212. The planar shape (pattern) of the grooves 216 on the polishing surface P22 is not specially limited, and, for example, examples thereof can include a radial shape, a concentric shape, a grid shape and a spiral shape. Moreover, the cross-sectional shape of the grooves 216 is not specially limited, and, for example, examples thereof can include a rectangle, a so-called U-shape, a so-called V-shape and a semi-circle. Furthermore, the pitch, the width or the depth of the grooves 216 is not specially limited as long as the polishing sludge can be discharged and the polishing slurry can move.

The dilatant material 214 with which the recess parts 218 are filled only has to be the above-mentioned dilatant material of the present embodiment, has been already described, and its description is omitted here.

A method for filling the recess parts 218 with the dilatant material 214 is not specially limited, but, for example, the filling may be performed by embedding of pressing the dilatant materials 214 into the recess parts 218. Otherwise, it may be performed by injecting the dilatant material 214 into the recess parts in the state where fluidity is given by heating or mixing with the medium liquid as described for the above-mentioned first aspect, followed by cooling or drying of the same, to give the dilatancy characteristics. Otherwise, the filling may be performed by molding the dilatant material 214 such that their shape matches the shapes of the recess parts 218, and after that, embedding them into the recess parts 218.

In the polishing pad 200 of the second aspect, the polishing layer 210 includes the dilatant material 214 which has higher viscosity by giving higher shearing strain as compared with the case of giving lower shearing strain. As a result, the polishing layer 210 has the dilatancy characteristics in the portion of the dilatant material 214, hence, the polishing rate of the object to be polished is dramatically enhanced when the relative speed is raised and/or the polishing pressure is increased in polishing, and thus, the polishing time can be dramatically reduced as compared with a polishing pad including a polishing layer using only a conventional material according to Prestonian's empirical rule. Furthermore, when polishing slurry is used in chemical mechanical polishing or the like, since the abrasive grains in the polishing slurry are embedded and held in the dilatant material 214, the polishing rate can be more enhanced. Moreover, since the dilatant material 214 change the viscosity as the relative speed changes, when the abrasive grains are desired to be efficiently embedded in the dilatant material 214, the relative speed and the polishing pressure only have to be reduced. After that, when the relative speed is raised, since the dilatant material 214 has the elevated viscosity and more rigidly holds the abrasive grains embedded therein, the abrasive grains can be effectively used for polishing. Specifically, according to the present aspect, while the polishing is being continued, both to embed and hold the abrasive grains can be more efficiently and securely performed. Moreover, the polishing pad 200 of the second aspect is particularly useful since the dilatant material can be used in the case where the polishing member (polishing layer) is difficult to be impregnated with the dilatant material. Furthermore, in the polishing pad 200 of the second aspect, an area ratio between the polishing surface P21 based on the dilatant material 214 and the polishing surface P22 based on the base material 212 can be arbitrarily adjusted, and polishing performance of the polishing pad 200 can be more easily controlled. Moreover, in the polishing pad 200 of the second aspect, since the polishing surface P21 based on the dilatant material 214 can be arranged at an arbitrary position, the polishing surface P21 can be selectively arranged on only the surface that comes into contact with the object to be polished, or on only the surface that highly frequently comes into contact with the object to be polished, and thereby, a smaller amount of dilatant material 214 can be used for more effective polishing of the object to be polished.

Figure 3:
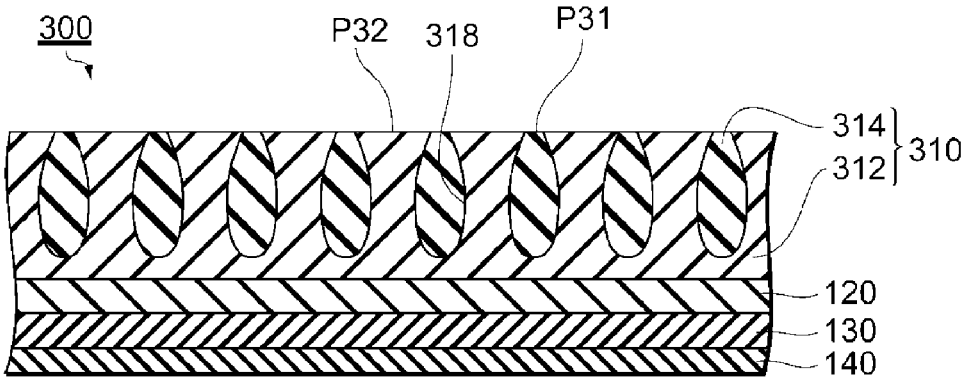
FIG. 3 is a schematic cross-sectional view showing still another example of the polishing pad of the present invention.

Similarly to the polishing pad 200 of the second aspect, in a polishing pad of a third aspect of the present embodiment, a polishing member contains a base material having recess parts and a dilatant material with which the interiors of the recess parts are filled. It should be noted that it is different from the polishing pad 200 of the second aspect in that the base material is of so-called suede type. FIG. 3 is a schematic cross-sectional view exemplarily showing such a polishing pad. A polishing pad 300 shown in FIG. 3 includes a polishing layer 310 which is a polishing member containing a base material 312 having recess parts 318 and a dilatant material 314 with which the interiors of the recess parts 318 are filled, the supporting member 120 supporting the polishing layer 310, the double-sided adhesive tape 130 and the release sheet 140, these stacked in this order. The polishing pad 300 causes a polishing surface P31 based on the dilatant material 314 of the polishing layer 310 and a polishing surface P32 based on the base material 312 thereof to come into contact with the object to be polished and polish it. The supporting member 120, the double-sided adhesive tape 130 and the release sheet 140 are the same as those included in the above-mentioned polishing pad 100 of the first aspect, and their description is omitted.

The plurality of recess parts 318 formed in the base material 312 are open pores opening on the polishing surface P31 side. The shape of the recess parts 318 is not specially limited, and it may be a conical shape or a spindle shape which is long in the thickness direction of the base material 312 as shown in the figure, or may be a substantially spherical shape. The base material 312 may have a plurality of not-shown closed pores other than the recess parts 318 which are open pores.

The base material 312 is not specially limited as long as it is one used as a polishing layer of a conventional polishing pad, in particular, a polishing pad of suede type, and examples of a material constituting the base material 312 can include, for example, resins such as a polyurethane resin, a polysulfone resin and a polyimide resin. One kind of these is solely used or two or more kinds of these are combined and used. Above all, the polyurethane resin is preferable in view of further effectively and securely achieving the object of the present invention.

Examples of the polyurethane resin can include, for example, a polyester-based polyurethane resin, a polyether-based polyurethane resin and a polycarbonate-based polyurethane resin. One kind of these is solely used or two or more kind of these are combined and used. Above all, the polyester-based polyurethane resin is preferable in view of more effectively and securely achieving the object of the present invention.

The polyurethane resin may be synthesized by a conventional method, or may be obtained as a commercial product. Examples of the commercial product can include, for example, Crisvon (product name by DIC Corporation), Sanprene (product name by Sanyo Chemical Industries, Ltd.), and Resamine (product name by Dainichiseika Color & Chemicals Mfg. Co., Ltd.).

The polysulfone resin may be synthesized by a conventional method, or may be obtained as a commercial product. Examples of the commercial product can include, for example, Udel (product name by Solvay).

The polyimide resin may be synthesized by a conventional method, or may be obtained as a commercial product. Examples of the commercial product can include, for example, Aurum (product name by Mitsui Chemicals, Inc.).

The base material 312 may contain one kind or two or more kinds of materials that may be typically contained in the polishing layer of the polishing pad, for example, pigments such as carbon black, a hydrophilic additive and a hydrophobic additive other than the above-mentioned resins. These arbitrarily used materials may be used for controlling the dimensions and the numbers of the recess parts 318 and the closed pores.

The base material 312 may contain a skin layer region having a microporous structure in which a plurality of finer pores are formed on the polishing surface P31 side, and a foaming resin region in which a plurality of larger pores (above-mentioned closed pores and open pores) are formed. The foaming resin region is formed on the opposite side of the skin layer region to the polishing surface P31, and its thickness is not specially limited, and, for example, is from 0.3 mm or more to 2.0 mm or less. In the foaming resin region, the recess parts 318 which are the plurality of open pores are formed in the resin which is the matrix, and the recess parts 318 open on the polishing surface P31 side via the skin layer.

The dimension of the openings of the recess parts 318 is not specially limited, and the average diameter of those is preferably from 5 μm or longer to 80 μm or shorter, still preferably from 20 μm or longer to 50 μm or shorter, in view of precision polishing. Within the above-mentioned range of the average diameter of the openings, scratches caused by clogging hardly arise and polishing can be performed with higher flatness. The average diameter (arithmetic mean) of the openings is obtained by image analysis of a binarized image from a microscope capturing an image of an arbitrary surface of the base material 312.

Moreover, the depth of the recess parts 318 is not specially limited, and its average is preferably from 200 μm or more to 1000 μm or less, still preferably 400 μm or more to 700 μm or less, in view of a property of filling with the dilatant material. The depth of the recess parts 318 is obtained by image analysis of an electron microgram obtained by capturing an image of an arbitrary cross-section of the base material 312.

The thickness of the base material 312 is not specially limited, but preferably from 0.3 mm or more to 1.5 mm or less. By the thickness of the base material 312 being not less than 0.3 mm, the operation time of the polishing pad 300 can be more secured, and by the same being not more than 1.5 mm, proper hardness of the base material 312 can be maintained and edge roll-off of the object to be polished can be more effectively prevented.

A compressibility of the base material 312 is preferably from 1% or more to 50% or less, still preferably from 2% or more to 20% or less, in view of usefulness in the case of using for finish polishing. Moreover, from the similar point of view, the 100% modulus of the resin contained in the base material 312 is preferably from 2 MPa or more to 50 MPa or less, still preferably from 10 MPa or more to 35 MPa or less. The compressibility is obtained using a Schopper-type thickness gauge (pressing surface: circular with 1 cm of diameter) based on the Japanese Industrial Standards (JIS L 1021). Specifically, a thickness t1 after pressing at the initial load for 30 seconds is measured, and next, a thickness t2 after being left still under the final pressure for 5 minutes is measured. Based on these, the compressibility is calculated by the following expression:

$$\text{Compressibility } (\%)=(t1-t2)/t1\times 100$$

In this stage, the initial load is set to be 100 g/cm$^2$ and the final pressure is set to be 1120 g/cm$^2$. The 100% modulus is the value obtained by dividing, by the cross-sectional area, the load exerted at the time when a foamless resin sheet using the same one as the resin contained in the base material 312 is stretched, that is, stretched to twice the original length thereof. Within the above-mentioned ranges of the compressibility and the 100% modulus, the object to be polished can be polished more efficiently with further higher quality due to proper characteristics of elasticity required for the polishing pad.

A method for manufacturing the base material 312 only has to be similar to a method for manufacturing a polishing layer in a conventional polishing pad of suede type. For example, the base material 312 can be obtained by so-called wet film formation having: a resin solution preparation step of mixing a resin such as a polyurethane resin, a solvent which can solve the resin and can be mixed with coagulation liquid, and as needed, other materials to be contained in the base material 312, and removing bubbles therefrom under a reduced pressure as needed to prepare a resin solution; an application step of applying the resin solution onto a base material for film formation; a coagulation and regeneration step of coagulating and regenerating the resin in the applied resin solution into a sheet shape to obtain a precursor sheet; and a solvent removal step of removing the solvent remaining in the precursor sheet to form the above-mentioned open pores (recess parts 318) and closed pores.

The dilatant material 314 with which the recess parts 318 are filled only has to be the above-mentioned dilatant material of the present embodiment, has been already described, and its description is omitted here.

A method for filling the recess parts 318 with the dilatant material 314 is not specially limited, and, for example, it may be performed by injecting the dilatant material 314 into the recess parts in the state where fluidity is given by heating or mixing with the medium liquid as described for the above-mentioned first aspect, followed by cooling or drying of the same, to give the dilatancy characteristics. Otherwise, in the case where the dilatant material 314 gains fluidity under heating (for example, in the case where it is a thermoplastic resin having dilatant characteristics or a resin composition containing the thermoplastic resin), after the dilatant material 314 is placed on the base material 312, the entirety of these may be heated in a thermostatic oven or the like, and thereby, the placed dilatant material 314 may be caused to flow to fill the interiors of the recess parts 318 therewith.

In the polishing pad 300 of the third aspect, the polishing layer 310 includes the dilatant material 314 which has higher viscosity by giving higher shearing strain as compared with the case of giving lower shearing strain. As a result, the polishing layer 310 has the dilatancy characteristics in the portion of the dilatant material 314, hence, the polishing rate of the object to be polished is dramatically enhanced when the relative speed is raised and the polishing pressure is increased in polishing, and thus, the polishing time can be dramatically reduced as compared with a polishing pad including a polishing layer using only a conventional material according to Prestonian's empirical rule. Furthermore, when polishing slurry is used in chemical mechanical polishing or the like, since the abrasive grains in the polishing slurry are embedded and held in the dilatant material 314, the polishing rate can be more enhanced. Moreover, since the dilatant material 314 changes the viscosity as the relative speed changes, when the abrasive grains are desired to be efficiently embedded in the dilatant material 314, the relative speed and the polishing pressure only have to be reduced. After that, when the relative speed is increased, since the dilatant material 314 has the elevated viscosity and more rigidly holds the abrasive grains embedded therein, the abrasive grains can be effectively used for polishing. Specifically, according to the present aspect, while the polishing is being continued, both to embed and hold the abrasive grains can be more efficiently and securely performed. Moreover, since in the polishing pad 300 of the third aspect, the base material 312 is a soft base material used for a polishing layer of a polishing pad of suede type, by reducing the polishing pressure and the relative speed, it can also be applied as a polishing pad used for final finishing. As a result, only using the polishing pad 300, it can also be widely applied up to finish polishing as well as primary polishing.

A polishing method using the polishing pad of the present embodiment has a step of polishing an object to be polished using the above-mentioned polishing pad. A specific example of the same is described. First, an object to be polished is caused to be held on a holding surface plate of a one-side polishing machine. Next, the polishing pad is attached onto a polishing surface plate arranged so as to oppose the holding surface plate. In the case where the polishing pad is attached onto the polishing surface plate, after the release sheet 140 is released off the double-sided adhesive tape 130 to expose the adhesive layer of the double-sided adhesive tape 130, the exposed adhesive layer is brought into contact with and pressed onto the polishing surface plate. Then, polishing slurry containing abrasive grains (abrasive particles) is circulatively supplied between the object to be polished and the polishing pad, in addition to this, the polishing surface plate or the holding surface plate is rotated with the object to be polished pressed toward the polishing pad at a predetermined polishing pressure, and thereby, the object to be polished is polished by chemical mechanical polishing. The polishing slurry is not specially limited, and may be conventional one used for chemical mechanical polishing and examples of the abrasive grains can include, for example, ceria, silica, manganese oxide and diamond. Among those abrasive grains, the abrasive grains made of the same material as that of the inorganic particles contained in the dilatant material are preferable in view of these being able to improve blending of the polishing slurry by combination with the polishing pad of the present embodiment in which the polishing member contains a hydrophobic dilatant material.

Moreover, before polishing using the polishing pad of the present embodiment, dressing processing (conditioning processing) is preferably performed in the state where the abrasive grains are embedded in the dilatant material contained in the polishing member of the polishing pad. Typically, in dressing processing, since shearing stress given to the polishing member is smaller than that in polishing, the viscosity of the polishing member in dressing processing is lower than the viscosity of the polishing member in polishing, in the present embodiment. Therefore, even in the case where the heights of the abrasive grains protruding from the polishing surface of the polishing member are not uniform before dressing processing, the protruding abrasive grains can be easily embedded in the dilatant material by the dressing processing, the heights of the protruding abrasive grains can be more easily arranged to be uniform. As a result, the abrasive grains embedded in the dilatant material can polish the object to be polished with more uniform energy in polishing, and surface roughness on the polished surface of the object to be polished can be made further smaller.

The polishing pad of the present embodiment can be preferably used for polishing optical materials such as a lens, a plane parallel plate and a reflection mirror, a substrate for a hard disk drive, a silicon wafer for a semiconductor, and a glass substrate for a liquid crystal display, and hard-to-process materials such as sapphire, SiC, GaN and diamond, and the like. In particular, it can be preferably used for polishing the hard-to-process materials such as sapphire, SiC, GaN and diamond, which are difficult to be more sufficiently polished under the restriction on performance of the apparatus and the restriction on time using a conventional polishing pad including a polishing layer that uses only a material according to Prestonian's empirical rule. According to the present embodiment, since the polishing rate can be dramatically enhanced by using the dilatant material, the above-mentioned hard-to-process material can be sufficiently polished in a relatively short time. Moreover, while a conventional polishing pad is only suitable for any one of rough polishing (primary polishing) and finish polishing (secondary polishing), the polishing pad of the present embodiment can be used for both rough polishing and finish polishing since an amount of change in polishing rate along with change in relative speed and polishing pressure is large.

As above, a mode for carrying out the present invention has been described, but the present invention is not limited to the above-mentioned present embodiment. The present invention can be variously modified without departing from the spirit and scope thereof. For example, while in the above-mentioned present embodiment, the polishing layer includes the supporting member 120, the double-sided adhesive tape 130 and the release sheet 140, the present invention is not limited to this. For example, the supporting member 120, the double-sided adhesive tape 130 and the release sheet 140 may not be included at all. Otherwise, the supporting member 120 may not be included, but in place of the double-sided adhesive tape 130, only an adhesive agent may be applied on the polishing layer to be laminated on the release sheet 140. It should be noted that the supporting member 120 is preferably included and the double-sided adhesive tape 130 is preferably used in consideration of making handling in transporting the polishing pad and in attaching the same to a polishing machine easy.

Moreover, also in the first and third aspects of the present embodiment, similarly to the second aspect, grooves may be formed on the polishing surface of the polishing layer, and on the contrary, in the second aspect, grooves may not be formed. Furthermore, in the second aspect, the material of the base material 212 may be changed to a sheet-like fiber base material such as non-woven fabrics. In this case, as the sheet-like fiber base material, the same one as that described in the first aspect of the present embodiment can be used. Furthermore, in the second aspect, the recess parts 218 may be filled with a dilatant material with which a fiber base material is impregnated.

Moreover, in the second aspect of the present embodiment, while the plurality of recess parts 218 exist and the interiors of the plurality of recess parts 218 are filled with the dilatant material 214, instead, one recess part may be formed in a major portion of the polishing layer except a circumferential edge of the polishing layer. Specifically, the polishing layer may have the polishing surface P22 based on the base material 212 only in a circumferential edge part and a major portion of the polishing surface of the polishing layer (for example, 80% or more based on the entirety of the polishing surface, still preferably 90% or more) may be occupied by the polishing surface based on the dilatant material 214. In this case, since the major portion of the polishing surface of the polishing layer is based on the dilatant material 214, the above-mentioned effects of the present invention due to using the dilatant material 214 can be more effectively and securely achieved.

EXAMPLES

Hereafter, while the present invention is described further in detail using Examples, the present invention is not limited to these.

Example 1

As a dilatant resin, a dimethylpolysiloxane resin made by Shin-Etsu Chemical Co. Ltd. (kinetic viscosity of a 30% xylene solution at 25° C.: 21000 cS, refractive index at 25° C.: 1.403, specific gravity at 25° C.: 0.97, flash point: 315° C. or more, volatile component at 150° C. for 3 hours: 1 to 3%) was prepared. Next, using a kneader, 80 parts by mass of the above-mentioned dilatant resin, and 20 parts by mass of ceria particles as inorganic oxide particles (product name "SHOROX-V2104" by Showa Denko K.K.) were uniformly kneaded and mixed to afford a dilatant material (1). The D coefficient (at 30° C., $G^*_{100\ HZ}/G^*_{1\ HZ}$, the same holds true for the below) of the obtained dilatant material (1) was 3.9, and the complex modulus of elasticity at 30° C. and 50 Hz of frequency was $2.34\times10^5$ Pa.

After the dilatant material (1) was placed on non-woven fabrics (commercial felt for handicrafts, density: 0.075 g/cm$^3$, thickness: 4 mm) in a container, and the entirety of these was contained in a thermostatic oven heated at 40° C. to impregnate the non-woven fabrics with the dilatant material (1). Then, the impregnated resultant was taken out of the thermostatic oven to be cooled and afford a polishing layer (polishing member). In this stage, it was visually confirmed that the impregnation with the dilatant material (1) had been done by approximately 3 mm from the polishing surface in the thickness direction of the non-woven fabrics. The polishing layer was cut away to be circular and to have 370ϕ of dimension, affording a polishing pad including only the polishing layer. After that, the polishing pad was pasted onto the rotational surface plate of a polishing apparatus on the surface side that was not impregnated with the dilatant material (1) with a double-sided adhesive tape, and after conditioning processing was performed for 10 minutes, a polishing test was performed. The result exhibited the polishing rate shown in FIG. 4. Conditioning processing conditions and polishing conditions here were set as follows.

[Conditioning Conditions]

CMP pad conditioner: diamond abrasive grains, #100 mesh

Initial conditioning: P=3 kPa, N=30 rpm, 20 minutes

Secondary conditioning: P=6 kPa, N=60 rpm, 10 minutes

[Polishing Conditions]

Polishing apparatus: desktop polishing apparatus (product name "MA-300D" by Musashino-denshi Co. Ltd.

Polishing slurry: product name "SHOROX-V2104" by Showa Denko K. K., abrasive grains: ceria particles (average particle diameter 0.4 μm), abrasive grain concentration: 5 mass %, solvent: pure water Polishing slurry flow rate: 20 mL/min Object to be polished: AS soda-lime glass, ϕ2 inches, 1.8 mm of thickness (made by Asahi Glass Co. Ltd.)

Surface plate rotation speed×polishing pressure: 4960 kPa·rpm/min

Figure 5:
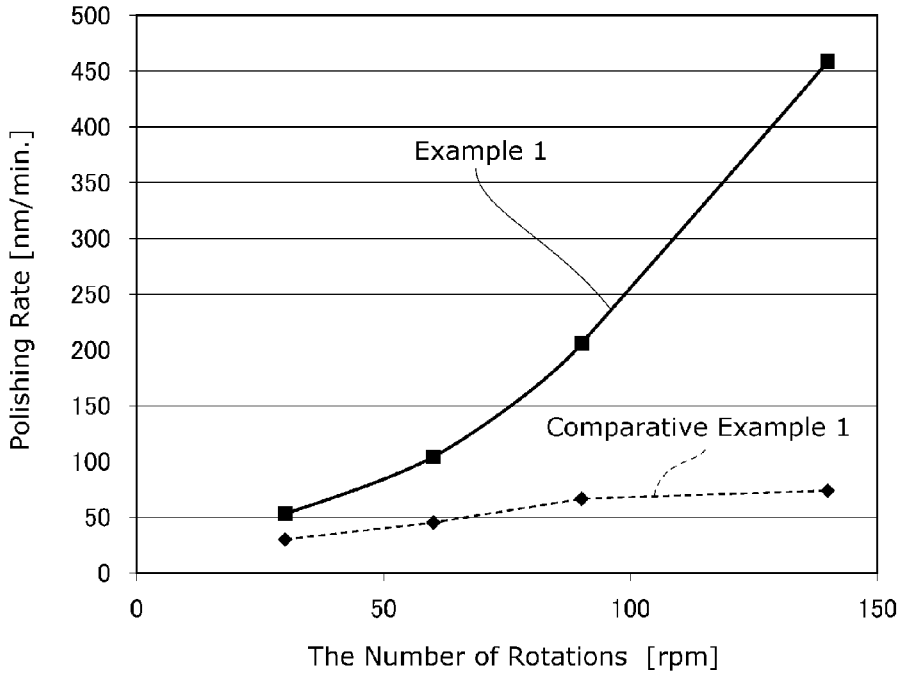
FIG. 5 is a diagram showing results of another polishing test in Examples.

Moreover, the polishing pressure was set to be 32.0 kPa, the number of rotations of the surface plate was changed to be 30 to 140 rpm/min, and change in polishing rate was observed, affording the results shown in FIG. 5.

Comparative Example 1

Figure 4:
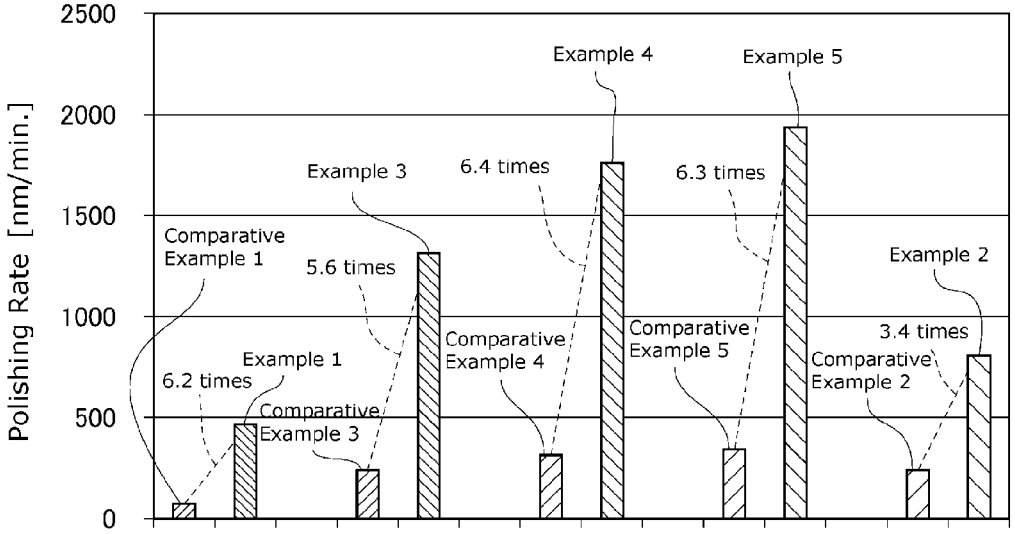
FIG. 4 is a diagram of a bar chart showing results of polishing tests in Examples.

A polishing pad was prepared similarly to Example 1 except for not using the dilatant material (1), and the polishing test was performed. The results were obtained as shown in FIG. 4 and FIG. 5.

Example 2

A hard pad (product name "MH-N15A" by Nitta Haas Incorporated, thickness: 1.1 mm, complex modulus of elasticity at 30° C. and 50 Hz of frequency: $2.16\times10^7$ Pa) was prepared and cut away to be a circle with 370ϕ. Next, recess parts (dimples) in cylindrical shapes with 10 mmϕ were formed on the polishing surface of the hard pad such that they were vertically and horizontally arranged at 15 mm of pitch into a grid shape on the entirety of the hard pad using an endmill. The depth of the recess parts was set to be 90% of the thickness of the hard pad (in other words, 1 mm). The dilatant material (1) prepared in Example 1 was embedded in the recess parts thus formed by pressing the same into them to fill them, affording a polishing pad including only a polishing layer. Next, similarly to Example 1, the polishing pad was pasted on the rotational surface plate of the polishing apparatus, and after the conditioning processing was performed for 30 minutes, the polishing test was performed. The result is shown in FIG. 4.

Figure 6:
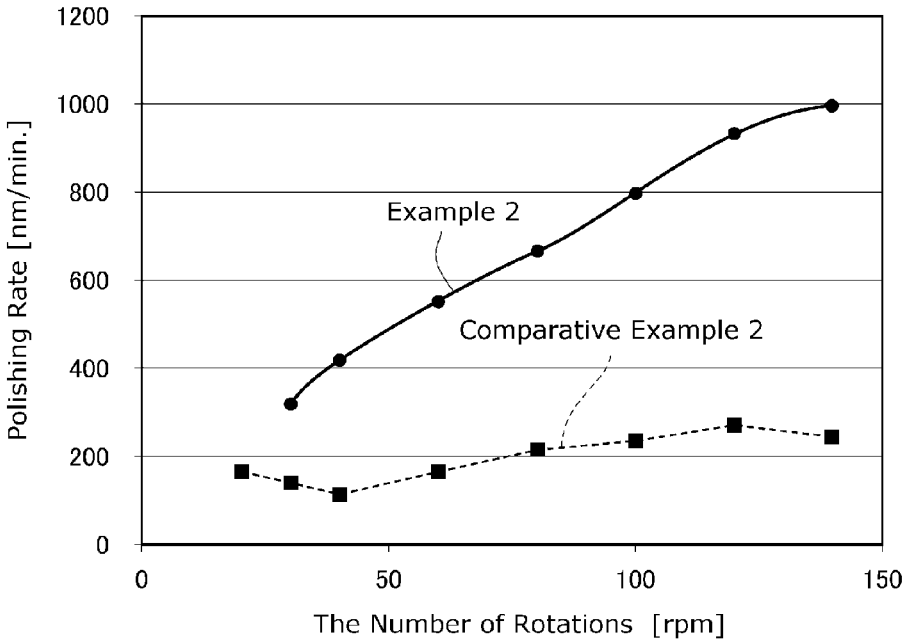
FIG. 6 is a diagram showing results of still another polishing test in Examples.

Moreover, the polishing pressure was set to be 49.6 kPa, the number of rotations of the surface plate was changed to be 20 to 140 rpm/min, and change in polishing rate was observed, affording the results shown in FIG. 6.

Comparative Example 2

A polishing pad was prepared similarly to Example 2 except for not forming the recess parts and not using the dilatant material (1), and the polishing test was performed. The results are shown in FIG. 4 and FIG. 6.

Example 3

Except for, in place of the non-woven fabrics (commercial felt for handicrafts, density: 0.075 g/cm$^3$, thickness: 4 mm), using a felt base material made by Fujibo Ehime Co. Ltd. which is non-woven fabrics (felt base material formed by needle punch on polyester fibers with 2 d×51 mm, density: 0.10 g/cm$^3$, thickness: 2.4 mm, complex modulus of elasticity at 30° C. and 50 Hz of frequency: $1.73\times10^6$ Pa), a polishing pad was obtained similarly to Example 1. An amount of impregnation with the dilatant material was set to be 90% of thickness of the felt base material (in other words, 2.2 mm). Notably, the complex modulus of elasticity of the polishing pad at 30° C. and 50 Hz of frequency was $8.22\times10^5$ Pa. Next, similarly to Example 1, the polishing pad was pasted on the rotational surface plate of the polishing apparatus, and after the conditioning processing was performed for 30 minutes, the polishing test was performed. The result is shown in FIG. 4. Notably, in Example 3, the polishing test which was performed in Examples 1 and 2 and whose results are shown in FIG. 5 and FIG. 6 was not performed (hereafter, the same holds true for Examples 4 and 5 and Comparative Examples 3 to 5).

Comparative Example 3

A polishing pad was prepared similarly to Example 3 except for not using the dilatant material (1), and the polishing test was performed. The result is shown in FIG. 4.

Example 4

A non-woven fabric pad (product name "FPK7000C" by Fujibo Ehime Co. Ltd., thickness: 1.3 mm, complex modulus of elasticity at 30° C. and 50 Hz of frequency: $1.42\times10^7$ Pa) was prepared and cut away to be a circle with 370ϕ. Next, recess parts (dimples) in cylindrical shapes with 10 mmϕ were formed on the polishing surface of the non-woven fabric pad such that they were vertically and horizontally arranged at 12 mm of pitch into a grid shape on the entirety of the non-woven fabric pad using an endmill. The depth of the recess parts was set to be 90% of the thickness of the hard pad (in other words, 1.2 mm). The dilatant material (1) prepared in Example 1 was embedded in the recess parts thus formed by pressing the same into them to fill them, affording a polishing pad including only a polishing layer. Next, similarly to Example 1, the polishing pad was pasted on the rotational surface plate of the polishing apparatus, and after the conditioning processing was performed for 30 minutes, the polishing test was performed. The result is shown in FIG. 4.

Comparative Example 4

A polishing pad was prepared similarly to Example 4 except for not forming the recess parts and not using the dilatant material (1), the polishing test was performed. The result is shown in FIG. 4.

Example 5

As a dilatant resin, a polysiloxane resin made by Bouncy (product name "Snatch Clay BX-100C") was prepared. Next, using a kneader, 80 parts by mass of the above-mentioned dilatant resin, and 20 parts by mass of ceria particles as inorganic oxide particles (product name "SHOROX-V2104" by Showa Denko K.K.) were uniformly kneaded and mixed to afford a dilatant material (2). The D coefficient of the obtained dilatant material (2) was 5.4, and the complex modulus of elasticity at 30° C. and 50 Hz of frequency was $1.28\times10^6$ Pa.

Next, a non-woven fabric pad (product name "FPK7000C" by Fujibo Ehime Co. Ltd., thickness: 1.3 mm, complex modulus of elasticity at 30° C. and 50 Hz of frequency: $1.42\times10^7$ Pa) was prepared and cut away to be a circle with 370ϕ. Next, recess parts (dimples) in cylindrical shapes with 10 mmϕ were formed on the polishing surface of the non-woven fabric pad such that they were vertically and horizontally arranged at 12 mm of pitch into a grid shape on the entirety of the non-woven fabric pad using an endmill. The depth of the recess parts was set to be 90% of the thickness of the hard pad (in other words, 1.2 mm). The dilatant material (2) was embedded in the recess parts thus formed by pressing the same into them to fill them, affording a polishing pad including only a polishing layer. Next, similarly to Example 1, the polishing pad was pasted on the rotational surface plate of the polishing apparatus, and after the conditioning processing was performed for 30 minutes, the polishing test was performed. The result is shown in FIG. 4.

As apparent from the results shown in FIG. 4, the polishing rate is improved by approximately 3 to 6 times under the polishing condition of 4960 kPa/min by using the polishing pads containing the dilatant materials. Moreover, as apparent from the results shown in FIG. 5, as to the pad obtained by impregnating the non-woven fabrics with the dilatant material, the exceeding effects due to the dilatant material are presented more as the rotation becomes higher, and the polishing rate does not become proportionally higher with respect to the number of rotations, but becomes exponentially higher. Furthermore, as apparent from the results shown in FIG. 6, even for the polishing pad having the hard urethane pad filled with the dilatant material, the improvement effect of the polishing rate due to the dilatant material can be observed.

This application is based upon Japanese Patent Application No. 2013-49471, filed on Mar. 12, 2013, the entire contents of which are incorporated herein by reference.

INDUSTRIAL APPLICABILITY

The polishing pad of the present invention can be preferably used for polishing optical materials such as a lens, a plane parallel plate and a reflection mirror, a substrate for a hard disk drive, a silicon wafer for a semiconductor, and a glass substrate for a liquid crystal display, and hard-to-process materials such as sapphire, SiC, GaN and diamond, and the like, and has industrial applicability in these fields. In particular, it can be preferably used for polishing the hard-to-process materials such as sapphire, SiC, GaN and diamond.

REFERENCE SIGNS LIST

100, 200, 300 Polishing pad
110, 210, 310 Polishing layer
120 Supporting member
130 Double-sided adhesive tape
140 Release sheet
214, 314 Dilatant material

The invention claimed is:

1. A polishing pad comprising a polishing member having a polishing surface, wherein the polishing member comprises a material having dilatancy characteristics, the material forming the polishing surface.

2. The polishing pad according to claim 1, wherein the material having the dilatancy characteristics comprises a resin having dilatancy characteristics, or an inorganic particle composition having dilatancy characteristics which comprises inorganic particles and medium liquid.

3. The polishing pad according to claim 2, wherein the polishing member comprises a sheet-like fiber base material, and the sheet-like fiber base material is impregnated with the material having the dilatancy characteristics.

4. The polishing pad according to claim 2, wherein the polishing member comprises a base material having a recess part, and the material having the dilatancy characteristics fills an interior of the recess part.

5. The polishing pad according to claim 1, wherein the material having the dilatancy characteristics comprises a resin having the dilatancy characteristics and further comprises inorganic particles.

6. The polishing pad according to claim 5, wherein the resin having the dilatancy characteristics comprises a silicone resin having dilatancy characteristics.

7. The polishing pad according to claim 5, wherein the polishing member comprises a sheet-like fiber base material, and the sheet-like fiber base material is impregnated with the material having the dilatancy characteristics.

8. The polishing pad according to claim 5, wherein the polishing member comprises a base material having a recess part, and the material having the dilatancy characteristics fills an interior of the recess part.

9. The polishing pad according to claim 1, wherein the material having the dilatancy characteristics comprises a silicone resin having dilatancy characteristics.

10. The polishing pad according to claim 9, wherein the polishing member comprises a sheet-like fiber base material, and the sheet-like fiber base material is impregnated with the material having the dilatancy characteristics.

11. The polishing pad according to claim 9, wherein the polishing member comprises a base material having a recess part, and the material having the dilatancy characteristics fills an interior of the recess part.

12. The polishing pad according to claim 1, wherein the polishing member comprises a sheet-like fiber base material, and the sheet-like fiber base material is impregnated with the material having the dilatancy characteristics.

13. The polishing pad according to claim 12, wherein the polishing member comprises a base material having a recess part, and the material having the dilatancy characteristics fills an interior of the recess part.

14. The polishing pad according to claim 1, wherein the polishing member comprises a base material having a recess part, and the material having the dilatancy characteristics fills an interior of the recess part.

15. A polishing method comprising a step of polishing an object to be polished using a polishing surface of a polishing pad of a polishing pad, wherein the polishing member comprises a material having dilatancy characteristics, the material forming the polishing surface of the polishing member.

16. The polishing method of claim 15, wherein the material having the dilatancy characteristics comprises a resin having dilatancy characteristics, or an inorganic particle composition having dilatancy characteristics which comprises inorganic particles and medium liquid.

17. The polishing method of claim 15, wherein the material having the dilatancy characteristics comprises a resin having the dilatancy characteristics and further comprises inorganic particles.

18. The polishing method of claim 15, wherein the material having the dilatancy characteristics comprises a silicon resin having the dilatancy characteristics.

19. The polishing method of claim 15, wherein the polishing member comprises a sheet-like fiber base material, and the sheet-like fiber base material is impregnated with the material having the dilatancy characteristics.

20. The polishing method of claim 15, wherein the polishing member comprises a base material having a recess part, and the material having the dilatancy characteristics fills an interior of the recess part.

* * * * *